US008967103B2

(12) United States Patent
Tanis et al.

(10) Patent No.: US 8,967,103 B2
(45) Date of Patent: Mar. 3, 2015

(54) VARIABLE VALVE TIMING ARRANGEMENT

(71) Applicant: Caterpillar Inc., Peoria, IL (US)

(72) Inventors: Derek A. Tanis, Peoria, IL (US); Joseph E. Roth, West Lafayette, IN (US); Aaron G. Foege, Westmont, IL (US)

(73) Assignee: Caterpillar Inc., Peoria, IL (US)

( * ) Notice: Subject to any disclaimer, the term of this patent is extended or adjusted under 35 U.S.C. 154(b) by 173 days.

(21) Appl. No.: 13/783,923

(22) Filed: Mar. 4, 2013

(65) Prior Publication Data

US 2014/0245979 A1 Sep. 4, 2014

(51) Int. Cl.

| | |
|---|---|
| ***F01L 1/34*** | (2006.01) |
| ***F01L 1/18*** | (2006.01) |
| ***F01L 13/00*** | (2006.01) |

(52) U.S. Cl.

CPC ..... *F01L 1/18* (2013.01); *F01L 13/0031* (2013.01)

USPC ..... 123/90.16; 123/90.61

(58) Field of Classification Search

CPC ..... F01L 13/0031; F01L 1/146

USPC ..... 123/90.15, 90.16, 90.61

See application file for complete search history.

(56) References Cited

U.S. PATENT DOCUMENTS

| | | | | |
|---|---|---|---|---|
| 3,585,974 | A * | 6/1971 | Weber | 123/90.12 |
| 5,709,179 | A * | 1/1998 | Hara et al. | 123/90.15 |
| 5,992,362 | A | 11/1999 | Helmin | |
| 6,973,901 | B2 * | 12/2005 | Machida | 123/90.16 |
| 7,546,823 | B2 | 6/2009 | Buelna | |
| 8,033,261 | B1 | 10/2011 | Robbins | |
| 8,701,608 | B2 * | 4/2014 | Xiong et al. | 123/90.16 |
| 2007/0199529 | A1 * | 8/2007 | Deane | 123/90.16 |
| 2008/0202455 | A1 * | 8/2008 | Diggs | 123/90.15 |

FOREIGN PATENT DOCUMENTS

| | | |
|---|---|---|
| EP | 2039892 | 3/2009 |
| WO | 9421897 | 9/1994 |
| WO | 2006092312 | 9/2006 |
| WO | WO 2011102253 A1 * | 8/2011 |

* cited by examiner

*Primary Examiner* — Thomas Denion
*Assistant Examiner* — Daniel Bernstein

(57) ABSTRACT

A variable valve timing arrangement for an engine system is disclosed. The variable valve timing arrangement includes a cam follower configured to follow a cam lobe. A pushrod is operably connected with the cam follower and a pushrod rotation mechanism is configured to selectively rotate the pushrod. Further, a cam follower adjustment mechanism is configured to reposition the cam follower based on the rotation of the pushrod.

20 Claims, 5 Drawing Sheets

VARIABLE VALVE TIMING ARRANGEMENT

TECHNICAL FIELD

The present disclosure relates generally to an internal combustion engine, and more particularly relates to a variable valve timing arrangement for the internal combustion engine.

BACKGROUND

Various developments have been made in the control and design of an internal combustion engine to improve fuel efficiency while meeting ever stricter emission requirements. Improvements in valve timing arrangements have been made to control timing as well as a degree of opening of the intake and exhaust valves. As the internal combustion engine are required to operate at a range of speeds and loading conditions, the variable valve timing arrangement may allow the flow of gases into and from the engine to be tailored based on the operating conditions.

PCT Publication Number 2006/092312 discloses a variable mechanical valve control of an internal combustion engine including a bottom camshaft for adjusting a valve stroke and an opening and closing time, said valve control enabling an extremely compact transmission gear to be achieved between a push rod drive and the inlet and outlet valves, to reduce the number of components required for the transmission gear and to obtain a mechanical valve train that is completely variable, with a bottom camshaft. To achieve this, an intermediate lever is connected to a valve push rod by means of a shaft, in such a way that a slide gate roller, which is rotatably mounted on the shaft, is displaced by the camshaft in a slide gate. According to the invention, a first contact surface on the intermediate lever is supported in a reinforced manner by means of a spring on an eccentric shaft, or on a second contact surface and a lever is displaced using a working curve, said lever opening and/or closing the two-way gas valves. Elements are also provided, in particular on a lifter that is located on the push rod for the additional adjustment of the phase position of the valve elevations of the two-way gas valves with simultaneous play-free adjustment of the valve stroke and the invention is also equipped with elements for the additional independently controllable valve stroke opening and closing for each camshaft rotation.

SUMMARY

In one aspect, a variable valve timing arrangement for an engine system is disclosed. The timing arrangement includes a cam lobe, a cam follower, a pushrod, a pushrod rotation mechanism, and a cam follower adjustment mechanism. The cam follower is configured to follow the cam lobe, the pushrod is operably connected with the cam follower. The pushrod rotation mechanism is configured to selectively rotate the pushrod. The cam follower adjustment mechanism is configured to reposition the cam follower based on the rotation of the pushrod.

In another aspect, a method of varying valve timing in the engine system is disclosed. The method includes determining the engine operating parameter, and selectively actuating the pushrod rotation mechanism to rotate the pushrod based on the engine operating parameter. The method further includes repositioning the cam follower by the cam follower adjustment mechanism based on the rotation of the pushrod.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
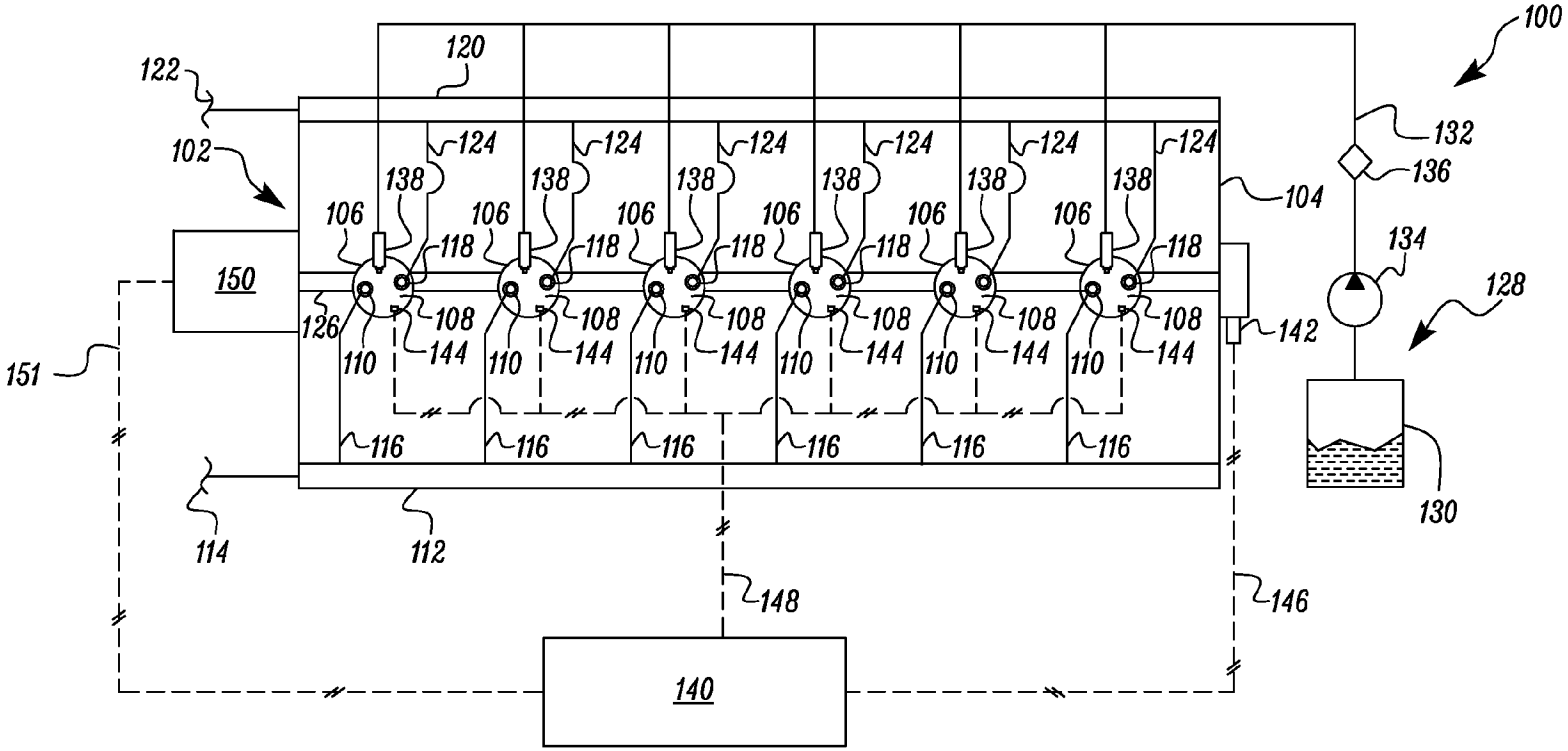
FIG. 1 illustrates an exemplary schematic view of an engine system.

FIG. 1 illustrates a schematic view of an exemplary engine system 100, in which various embodiments of the present disclosure may be implemented. The engine system 100 includes a reciprocating internal combustion engine 102. In one embodiment, the engine 102 may be a diesel engine. In alternative embodiments, the engine 102 may be a gasoline engine or any other reciprocating internal combustion engine as known in the art. The engine 102 may include an engine block 104 in which a plurality of cylinder assemblies 106 are disposed within. Although a plurality of cylinder assemblies 106 are shown in FIG. 1, other embodiments of the engine 102 may include only one cylinder assembly 106. The cylinder assemblies 106 of the engine 102 may be disposed in any configuration, such as but not limited to, in-line engine configuration, V-engine configuration, U-engine configuration, or W-configuration.

The cylinder assembly 106 includes a combustion chamber 108. The cylinder assembly 106 may include one or more overhead valves such as intake valves 110, to control air flow into the combustion chamber 108. A hollow runner or intake manifold 112 may be formed in or attached to the engine block 104 such that it extends over or proximate to each of the cylinder assemblies 106. The intake manifold 112 may communicate with an intake line 114 that directs air to the engine 102. Fluid communication between the intake manifold 112 and the cylinder assemblies 106 may be established by a plurality of intake runners 116 extending from the intake manifold 112. In the illustrated embodiment, the intake valves 110 open and close to selectively introduce the intake air from the intake manifold 112 into the combustion chamber 108.

The cylinder assembly 106 further includes one or more exhaust valves 118 to direct exhaust gases out of the combustion chamber 108 after a combustion event. An exhaust manifold 120 communicating with an exhaust line 122 may be disposed in or proximate to the engine block 104 such that it extends over or proximate to each of the cylinder assemblies 106. The exhaust manifold 120 may receive exhaust gasses by selective opening and closing of the one or more exhaust valves 118 associated with each cylinder assembly 106. The exhaust manifold 120 may communicate with the cylinder assemblies 106 through exhaust runners 124 extending from the exhaust manifold 120.

As shown in the illustrated embodiment, the intake valves 110 and the exhaust valves 118 are provided in an overhead position of the cylinder assemblies 106 and are selectively actuated by a camshaft 126 disposed within the engine block 104. In alternative embodiments, at least one of the intake valves 110 or the exhaust valves 118 may be placed at the overhead position and other intake and/or exhaust valves 110, 118 may be disposed in the engine block 104 such as at a sidewall of the cylinder assemblies 106 or other positions as known in the art.

The engine system 100 includes a fuel system 128 configured to supply fuel to the engine 102 during operation. In the illustrated embodiment, the fuel system 128 includes a fuel reservoir 130 that can accommodate a hydrocarbon-based fuel such as diesel, gasoline etc. A fuel line 132 directs the fuel from the fuel reservoir 130 into the cylinder assemblies 106. To pressurize the fuel and force it through the fuel line 132, a fuel pump 134 may be disposed in the fuel line 132. An optional fuel conditioner 136 may also be disposed in the fuel line 132 to filter the fuel or otherwise condition the fuel by, for example, introducing additives to the fuel, heating the fuel, removing water, and the like.

To introduce the fuel into the cylinder assemblies 106, the fuel line 132 may be in fluid communication with one or more fuel injectors 138 that are associated with each of the cylinder assemblies 106. While the illustrated embodiment depicts the fuel line 132 terminating at the fuel injectors 138, the fuel line 132 may establish a fuel loop that continuously circulates fuel through the plurality of fuel injectors 138 and, optionally, delivers unused fuel back to the fuel reservoir 130. Alternatively, the fuel line 132 may include a fuel collector volume or rail (not shown), which supplies pressurized fuel to the fuel injectors 138. The fuel injectors 138 may be electrically actuated devices that selectively introduce a measured or predetermined quantity of fuel into each cylinder assemblies 106. In alternative embodiments, the engine system 100 may include other fuel systems 128 as known in the art.

To coordinate and control the various systems and components associated with the engine system 100, the engine system 100 includes an electronic or computerized control unit, module, or controller 140. The controller 140 may be adapted to monitor various operating parameters and to responsively regulate various variables and functions affecting operations of the engine system 100. The controller 140 may include a microprocessor, an application specific integrated circuit (ASIC), or other appropriate circuitry, and may have memory or other data storage capabilities. The controller 140 may perform operations, include functions, steps, routines, data tables, data maps, charts, and the like, saved in, and executable from, read only memory, or another electronically accessible storage medium, to control the engine system 100. Although in FIG. 1, the controller 140 is illustrated as a single, discrete unit, in other embodiments, the controller 140 and its functions may be distributed among a plurality of distinct and separate components. The single unit or multiple component controller 140 may be located on-board the engine 102, a machine powered by the engine 102, and/or in a remote location.

The controller 140 may include means for determining various engine operating parameters, based at least in part, on signals received from one or more engine operating parameter sensors associated with the engine system 100. The engine operating parameter sensors may be configured to generate engine operating parameter signals indicative of a particular engine operating parameter. In an embodiment, the controller may determine engine speed and cylinder pressure using a speed sensor 142 and one or more cylinder pressure sensors 144. The speed sensor 142 and the cylinder pressure sensors 144 may be operatively connected to the controller 140 via a first communication link 146 and a second communication link 148, respectively. Alternatively, the engine operating parameters may include, but are not limited to, loading conditions, power output, engine temperature, fuel mass flow rate, air mass flow rate, and the like. In one embodiment, the controller 140 is configured to generate a desired valve timing signal indicative of a desired valve timing to control a variable valve timing arrangement 150 via a third communication link 151 as a function of the engine operating parameters, which is further explained in relation to FIGS. 2 to 4.

Figure 2:
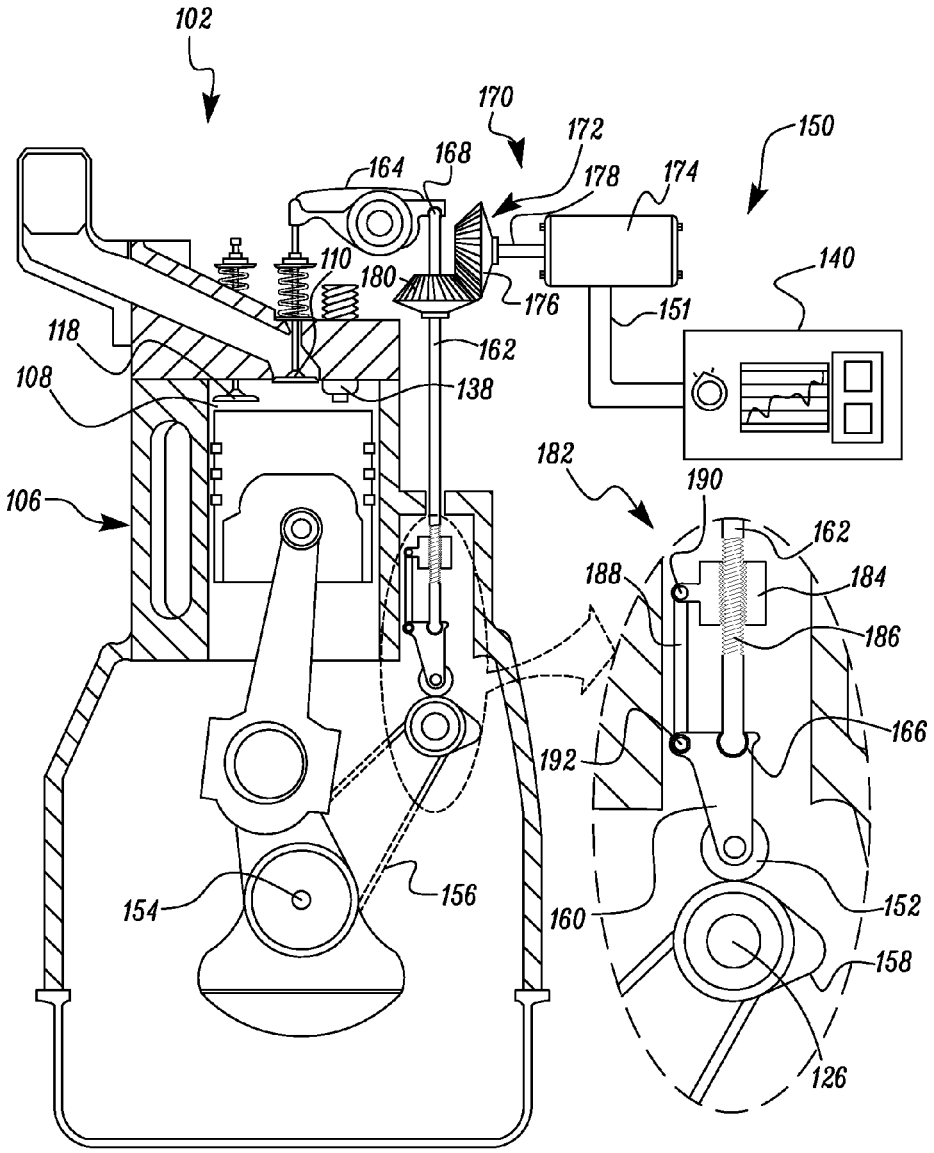
FIG. 2 illustrates an exemplary variable valve timing arrangement for the engine system of FIG. 1 with a cam follower in normal position.
Figure 3:
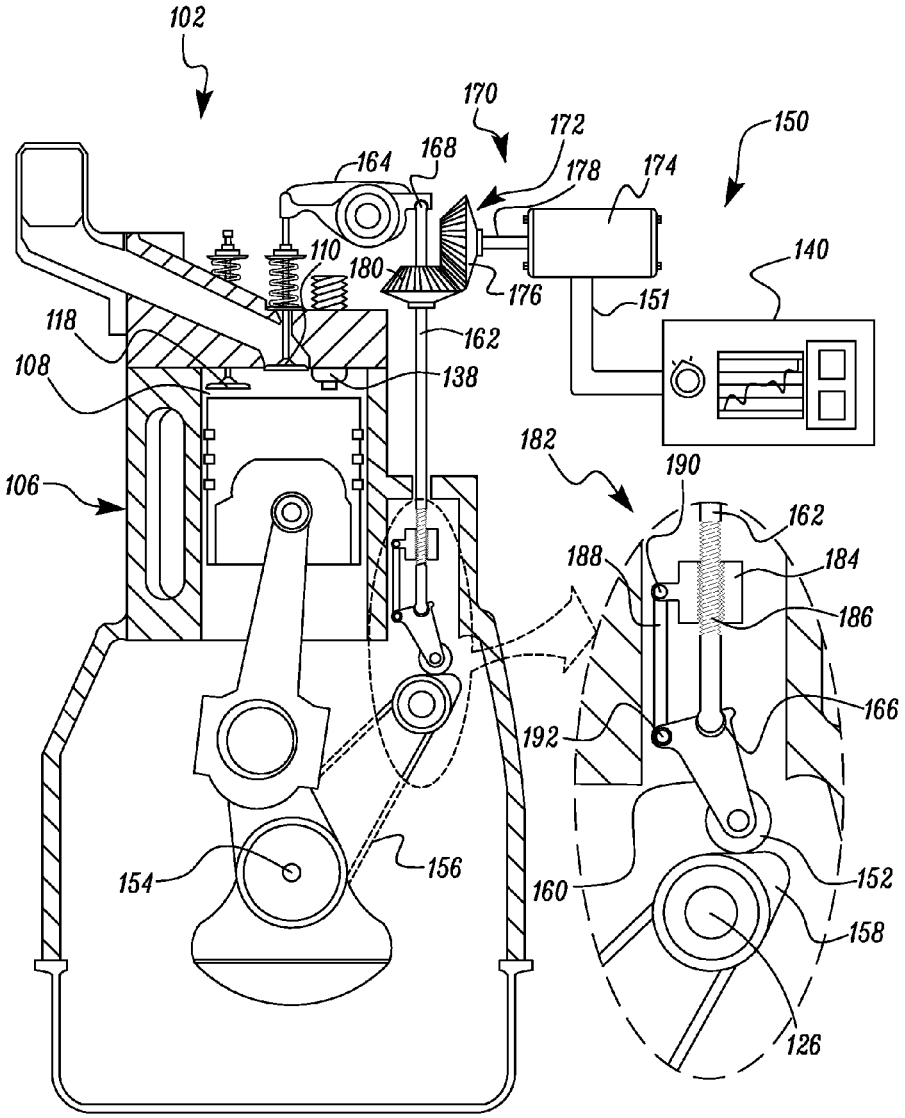
FIG. 3 illustrates the variable valve timing arrangement of FIG. 2 with the cam follower in advanced position.
Figure 4:
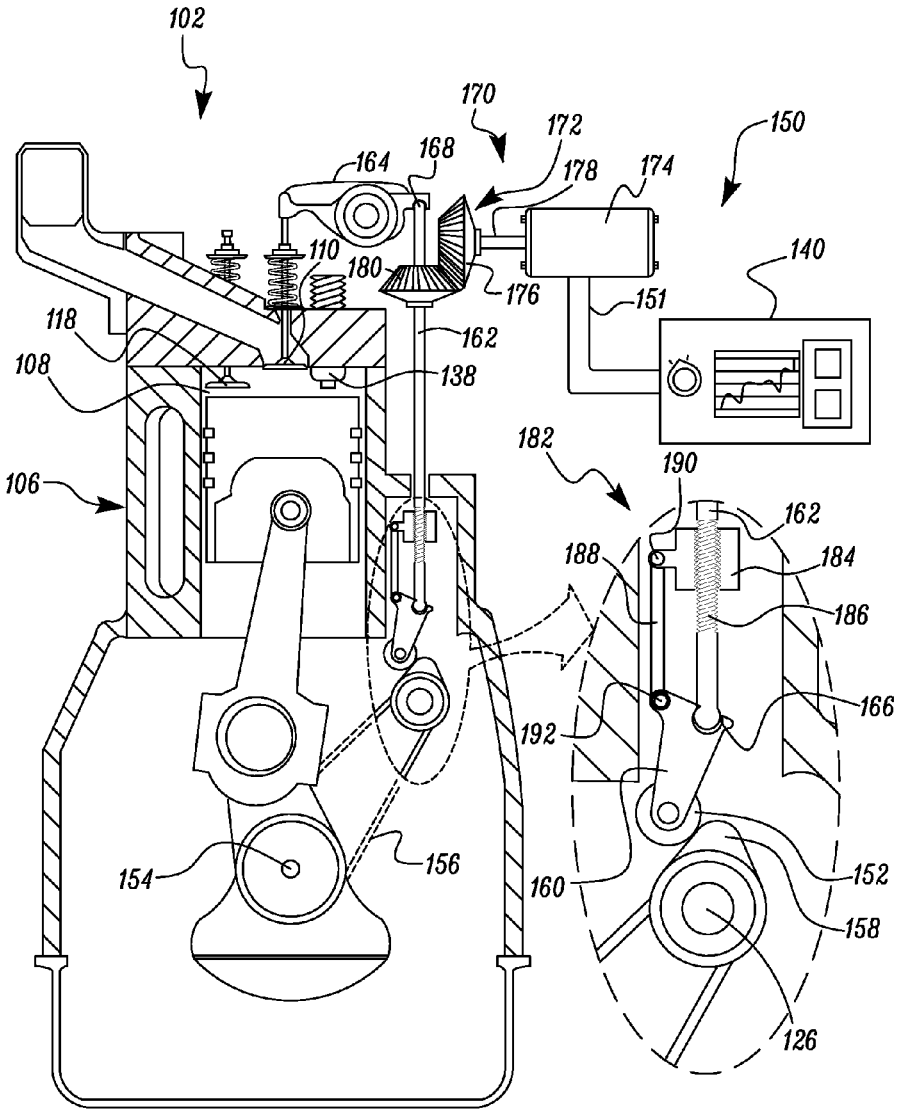
FIG. 4 illustrates the variable valve timing arrangement of FIG. 2 with the cam follower in retarded position.

Referring now to FIGS. 2, 3, and 4 an embodiment of the variable valve timing arrangement 150 is illustrated with the engine system 100 of FIG. 1. The variable valve timing arrangement 150 is operatively connected to the intake and/or the exhaust valves 110, 118 of the engine 102 and is configured to vary timing for the opening and closing of the valves 110, 118. The camshaft 126 may be disposed substantially beside and slightly above a crankshaft 154 in the engine 102, as shown in FIGS. 2-4. The camshaft 126 may be driven by the crankshaft 154 via a transmission means 156, such as, but not limited to gears, or belts. The variable valve timing arrangement 150 may include a cam follower 152 configured to follow one or more cam lobes 158 disposed along a length of the camshaft 126. As the camshaft 126 rotates, the cam lobes 158 may cause the intake and the exhaust valves 110, 118 to move up and down in a desired manner for the respective cylinder assemblies 106. The movement of the intake and the exhaust valves 110, 118 may seal and unseal ports leading into the combustion chamber 108. In an alternative embodiment, such as a two stroke engine 102, the cam lobes 158 may be disposed integrally on the crankshaft 154 of the engine 102.

The cam follower 152 may be a roller-type follower. Alternative embodiments of the cam follower 152 may include, but are not limited to, a flat follower, a point/knife follower, or an offset follower. The rotary motion of the camshaft 126 may be converted to a reciprocating motion of the cam follower 152 via the cam lobes 158. In the illustrated embodiment, the cam follower 152 is rotatably supported at a distal end of a tappet 160.

A pushrod 162 may be operatively connected with the cam follower 152. The pushrod 162 may be rotatably mounted at a proximal end of the tappet 160. The pushrod 162 may be connected to a rocker arm 164. The pushrod 162 may be linked to the tappet 160 by way of a first joint 166, such as, a ball-and-socket, a swivel, or a turn-and-slide joint. The pushrod 162 may be linked to the rocker arm 164 by way of a second joint 168, such as a ball-and-socket, a swivel, or a turn-and-slide joint. As illustrated, the intake valve 110 may be actuated by the rocker arm 164, which is articulated with the tappet 160 and the pushrod 162, to push at the intake valve 110. It will apparent to a person having ordinary skill in the art that, a substantially similar valve actuation mechanism may also be provided for the exhaust valve 118.

The variable valve timing arrangement 150 may include a pushrod rotation mechanism 170 configured to selectively rotate the pushrod 162 based on the desired valve timing signal received from the controller 140. The pushrod rotation mechanism 170 may include a rotating means 172 driven by a motor 174. The rotating means 172 may be a set of gears, such as, but not limited to, a set of bevel gears. The rotating means 172 may include a first bevel gear 176 operatively connected to an output shaft 178 of the motor 174. The first bevel gear 176 is drivably connected to a second bevel gear 180 disposed on the pushrod 162 and configured to rotate the pushrod 162. In alternative embodiments, the rotating means 172 may include other embodiments, such as, but not limited to, a belt or a chain.

The variable valve timing arrangement 150 may include a cam follower adjustment mechanism 182, as illustrated in a magnified view, the cam follower adjustment mechanism 182 may be configured to reposition the cam follower 152 based on the rotation of the pushrod 162. The cam follower adjustment mechanism 182 may include a block 184, slidably disposed on the pushrod 162. The block 184 may be fastened on the pushrod 162 via threads 186. The threads 186 on the pushrod 162 may allow the block 184 to slide up or down along the pushrod 162 based on the rotation of the pushrod 162. The sliding movement of the block 184 may control the position of the cam follower 152 attached to the tappet 160 via a linkage arm 188. The linkage arm 188 may be pivotally connected to the block 184 at a first pivot point 190. The linkage arm 188 may pivotally connected to the tappet 160 at a second pivot point 192. The block 184 may be slidably keyed into the engine block 104 to prevent rotation of the block 184 along with the pushrod 162.

FIG. 2 illustrates an exemplary embodiment of the engine system 100 with the cam follower 152 in a normal position for actuation of the intake or the exhaust valves 110, 118. FIG. 2 illustrates the same exemplary embodiment of the engine system 100 with the cam follower 152 in an advanced position for advancing the opening of the intake or the exhaust valves 110, 118. FIG. 3 illustrates the same exemplary embodiment of the engine system 100 with the cam follower 152 in a retarded position for delaying the opening of the intake or the exhaust valves 110, 118. The linkage arm 188 associated with the block 184 and the tappet 160 may selectively reposition the cam follower 152 based on rotation of the push rod 162.

Referring to FIG. 3, the first bevel gear 176 and the second bevel gear 180 may rotate the push rod 162 a first direction (shown by arrow) via the output shaft 178 of the motor 174. During the rotation of the push rod 162 in the first direction, the threads 186 on the pushrod 162 may allow the block 184 to slide down along the pushrod 162. The downward sliding movement of the block 184 along the pushrod 162 may position the cam follower 152 in the advanced position from the normal position via the linkage arm 188.

Referring to FIG. 4, the first bevel gear 176 and the second bevel gear 180 may rotate the push rod 162 in a second direction (shown by arrow) via the output shaft 178 of the motor 174. During the rotation of the push rod 162 in the second direction, the threads 186 on the pushrod 162 may allow the block 184 to slide up along the pushrod 162. The upward sliding movement of the block 184 on the pushrod 162 may position the cam follower 152 in the retarded position from the normal position via the linkage arm 188. Further, the rotation and the direction of rotation of the motor 174 may be controlled based on the desired valve timing signal received from the controller 140. Accordingly, the cam follower 152 may selectively advance, retard the opening and closing of the intake or the exhaust valves 110, 118 based on the desired valve timing signal.

Industrial Applicability

Varying valve timing of an engine 102 in response to or as a function of engine operating conditions and/or parameters may enable the engine 102 to operate more efficiently and/or produce less of some gaseous emissions. The variable valve timing arrangement may be used in applications such as motor vehicles, machines, locomotives or marine engines, and in stationary applications such as electrical power generators, small mechanical engines such as lawn mowers, all terrain vehicles (ATVs), generators, etc.

Figure 5:
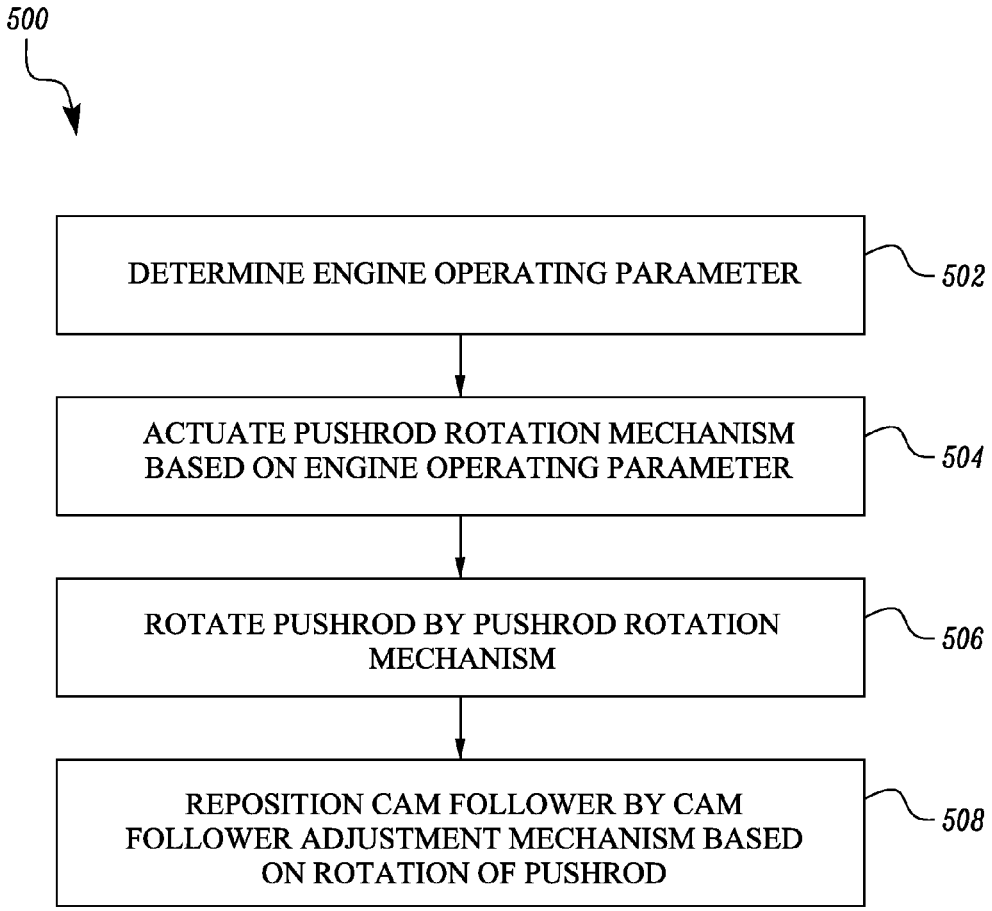
FIG. 5 illustrates an exemplary flowchart of a method for varying valve timing in the engine system.

FIG. 5 illustrates a flowchart of a method 500 for varying valve timing in an engine system 100. At step 502 of the method 500, the controller 140 may determine one or more engine operating parameters using the one or more engine operating parameter sensors such as the speed sensor 142, and the cylinder pressure sensors 144. The controller 140 may determine the desired valve timing as a function of the engine operating parameter and actuate the pushrod rotation mechanism 170, at step 504. The controller 140 may apply stored information about cam lobes 158 profiles along with the engine operating parameters to determine the desired valve timing.

At step 506, the motor 174 may include a means receiving the desired timing signal from the controller 140 and driving the rotating means 172 via the output shaft 178 to rotate the pushrod 162. At step 508, the cam follower adjustment mechanism 182 including the block 184 fastened on the pushrod 162 via the threads 186 may move along the pushrod 162 based on the rotation of the pushrod 162 and reposition the cam follower 152 via a linkage arm 188. The repositioning of the cam follower 152 may selectively advance or retard opening and closing of one or more overhead intake or exhaust valves 110, 118.

The cam follower 152 may be repositioned into the advanced position (as illustrated in FIG. 3) or the retarded position (as illustrated in FIG. 4) along the profile of the cam lobes 158 thus advancing or delaying the intake or the exhaust valves 110, 118 opening timing. The variable valve timing may increase efficiency of the engine 102 by optimizing air flow in the engine 102. The increased efficiency is manifested as better fuel economy and/or more power for a given engine displacement. In an embodiment, the controller may determine the desired valve timing for the intake and exhaust valves 110, 118 to adjust a degree of overlap between the openings of the intake and exhaust valves 110, 118 to improve fuel economy based on the load and speed of the engine 102.

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A variable valve timing arrangement for an engine system comprising:

a cam lobe;

a cam follower configured to follow the cam lobe;

a pushrod operatively connected with the cam follower;

a pushrod rotation mechanism configured to selectively rotate the pushrod; and a cam follower adjustment mechanism configured to reposition the cam follower based on the rotation of the pushrod.

2. The variable valve timing arrangement of claim 1 further comprises a controller, the controller is configured to generate a desired valve timing signal as a function of an engine operating parameter.

3. The variable valve timing arrangement of claim 2, wherein the controller is configured to determine the engine operating parameter using an engine operating parameter sensor associated with the engine system.

4. The variable valve timing arrangement of claim 2, wherein the pushrod rotation mechanism comprises a rotating means to selectively rotate the pushrod based on the desired valve timing signal received from the controller.

5. The variable valve timing arrangement of claim 1, wherein the cam follower adjustment mechanism comprises a block slidably disposed on the pushrod.

6. The variable valve timing arrangement of claim 5, wherein the block is fastened on the pushrod via threads, the threads allow the block to slide up or down along the pushrod based on the rotation of the pushrod.

7. The variable valve timing arrangement of claim 5, wherein the cam follower adjustment mechanism further comprises a linkage arm pivotally connected to the block and a tappet, wherein the cam follower is rotatably supported at a distal end of the tappet.

8. The variable valve timing arrangement of claim 7, wherein the linkage arm is pivotally connected to the block and the tappet at a first pivot point and a second pivot point, respectively.

9. An engine system comprising:

a reciprocating internal combustion engine;

a cylinder assembly of the reciprocating internal combustion engine, the cylinder assembly having one or more overhead valves; and a variable valve timing arrangement operatively connected to the one or more overhead valves, the variable valve timing arrangement comprising:

a cam lobe;

a cam follower configured to follow the cam lobe;

a pushrod operatively connected with the cam follower;

a pushrod rotation mechanism configured to selectively rotate the pushrod; and a cam follower adjustment mechanism configured to reposition the cam follower based on the rotation of the pushrod.

10. The engine system of claim 9 further comprises a controller, the controller is configured to generate a desired valve timing signal as a function of an engine operating parameter.

11. The engine system of claim 10, wherein the controller is configured to determine the engine operating parameter using an engine operating parameter sensor associated with the engine system.

12. The engine system of claim 10, wherein the pushrod rotation mechanism comprises a rotating means to selectively rotate the pushrod based on the desired valve timing signal received from the controller.

13. The engine system of claim 9, wherein the cam follower adjustment mechanism comprises a block slidably disposed on the pushrod.

14. The engine system of claim 13, wherein the block is fastened on the pushrod via threads, the threads allow the block to slide up or down along the pushrod based on the rotation of the pushrod.

15. The engine system of claim 13, wherein the cam follower adjustment mechanism further comprises a linkage arm pivotally connected to the block and a tappet, wherein the cam follower is rotatably supported at a distal end of the tappet.

16. The engine system of claim 15, wherein the linkage arm is pivotally connected to the block and the tappet at a first pivot point and a second pivot point, respectively.

17. A method for varying valve timing in an engine system comprising:

determining an engine operating parameter;

actuating a pushrod rotation mechanism based on the engine operating parameter;

rotating a pushrod by the pushrod rotation mechanism; and repositioning a cam follower by a cam follower adjustment mechanism based on the rotation of the pushrod.

18. The method of claim 17 further comprising determining a desired valve timing as a function of the engine operating parameter.

19. The method of claim 18, wherein the rotating the pushrod by the pushrod rotation mechanism comprising actuating a rotating means to selectively rotate the pushrod based on the desired valve timing.

20. The method of claim 17, wherein the repositioning of the cam follower comprising sliding a block along the pushrod based on the rotation of the pushrod via a linkage arm and selectively advancing or retarding opening and closing of one or more overhead valves.

* * * * *

UNITED STATES PATENT AND TRADEMARK OFFICE

CERTIFICATE OF CORRECTION

PATENT NO. : 8,967,103 B2
APPLICATION NO. : 13/783923
DATED : March 3, 2015
INVENTOR(S) : Tanis et al.

It is certified that error appears in the above-identified patent and that said Letters Patent is hereby corrected as shown below:

In the Specification:

Column 5, line 51, delete "Industrial Applicability" and insert -- INDUSTRIAL APPLICABILITY --.

Signed and Sealed this
Nineteenth Day of January, 2016

Michelle K. Lee

Michelle K. Lee
*Director of the United States Patent and Trademark Office*